US005827041A

United States Patent [19]

Charhut

[11] Patent Number: 5,827,041

[45] Date of Patent: Oct. 27, 1998

[54] PUMP AND SEAL ARRANGEMENT TO PREVENT LEAKAGE DUE TO FLUID BOILING AND CAVITATION

[76] Inventor: Frank J. Charhut, 139 Riverside Dr., Northfield, Ill. 60093

[21] Appl. No.: 620,835

[22] Filed: Mar. 25, 1996

[51] Int. Cl.[6] ..... F04D 29/12; F04D 29/16

[52] U.S. Cl. ..... 415/112; 415/111; 415/113; 415/58.2

[58] Field of Search ..... 415/58.2, 112, 415/113, 58.4, 111

[56] References Cited

U.S. PATENT DOCUMENTS

| | | | |
|---|---|---|---|
| 1,474,454 | 11/1923 | Telfer | 415/58.4 |
| 2,331,641 | 10/1943 | Walker | 415/112 |
| 2,741,991 | 4/1956 | Disbrow | 415/58.2 |
| 3,070,028 | 12/1962 | Loy et al. | 415/111 |
| 4,621,981 | 11/1986 | Lorett | 415/112 |
| 5,156,522 | 10/1992 | Tessier | 415/58.2 |

*Primary Examiner*—Christopher Verdier
*Attorney, Agent, or Firm*—Martin Faier

[57] ABSTRACT

A fluid pump having a pump body defining a pump cavity and a pump shaft rotatable on a bearing in the cavity, wherein the pump cavity contains a seal in a closed chamber between the pump body and the shaft, and the cavity is characterized by a first zone for high pressure pump discharge fluid, a second zone for low pressure pump inlet fluid, and an interconnecting passage which supplies fluid from the high pressure zone to a third zone, which exists at an intermediate pressure surrounding the pump seal and discharges its fluid into the low pressure zone, the intermediate pressure being sufficient to prevent fluid boiling and cavitation by insuring that the pumped fluid does not exceed its vapor pressure point.

8 Claims, 6 Drawing Sheets

PUMP AND SEAL ARRANGEMENT TO PREVENT LEAKAGE DUE TO FLUID BOILING AND CAVITATION

BACKGROUND OF THE INVENTION

This invention relates to an arrangement of a pump and face seal disposed to prevent leakage due to fluid boiling and cavitation, and is more particularly concerned with means for creating an artificial environment around the seal insuring that the fluid to be sealed does not exceed its vapor pressure.

Fluid pumps often use face type seals to prevent fluid from entering the pump shaft bearing area. Such face type seals rely upon two flat surfaces rubbing together to create a dynamic seal. This rubbing motion produces frictional heat which is dissipated to the sealed fluid. When the sealed fluid exceeds its vapor pressure point, either by a decrease of its pressure or an increase in its temperature, the fluid boils and cavitates. Such cavitation upsets the seal faces and causes leakage. If the sealed fluid is a solution, such as a coolant consisting of several phases, and its vapor pressure point is exceeded, phase separation results, producing residue which deposits on the seal faces, also causing leakage.

Although the discharged fluid from the pump may be free from cavitation, fluid boiling and cavitation can exist in the pump cavity. Zones occur in which the fluid is thermally agitated or may encounter a reduced pressure. The area in the pump where the face seal is positioned is known as the seal cavity. It is common in conventional pump and seal arrangements for a fluid to exist in the pump seal cavity which has exceeded its vapor pressure.

SUMMARY OF THE INVENTION

In the arrangement of the pump and seal embodying the present invention, zones in the pump cavity are identified, one of which being a first zone which contains high pressure pump discharge fluid, another of which or a second zone containing low or lesser pressure or perhaps negative pressure pump inlet fluid, and a third zone, created in accordance with the present invention, which contains an intermediate pressure sufficient to exceed the vapor pressure point of the fluid. The pressure of the last mentioned or intermediate pressure third zone obtains its pressure from the high pressure or first zone and discharges into the low or negative pressure second zone. This third zone does not naturally exist in known present pump — seal arrangements, but is created in accordance with the present invention.

The volume of the fluid flowing in the intermediate pressure zone is not relevant to the present invention, although the flow of fluid within said intermediate zone is essential for heat transfer within the zone to prevent the fluid from boiling and thus cavitating within the seal chamber. Secondary pumps and fluid sources are not essential for the functioning of the anti-cavitation zone disclosed in this application, as the pumped fluid itself is utilized to cool the seal and maintain the fluid flow at less than the vapor pressure point of the fluid.

While centrifugal pumps are hereafter illustrated to teach the invention, the inventive concept may also be utilized in vane pumps, gear pumps, wobble plate pumps, and other conventional pumps, by connecting pressure transfer ducts between high pressure and lesser pressure zones of the pump to create an environment surrounding the seal, thus insuring that the fluid in the seal cavity area is not boiling or cavitating.

OBJECTS OF THE INVENTION

It is the object of the invention to provide a pump and seal arrangement of the character recited.

Another object is to create an artificial environment around the seal to insure that the fluid to be sealed does not exceed its vapor pressure.

A further object is to achieve such an artificial environment using the pumped fluid, without the necessity of using external fluids or pumps.

Another object is to provide a pump-seal configuration having an identified pressure zone in the seal cavity area, and supplying this zone with high pressure fluid from the pump outlet to assure that fluid pressure in the cavity area is maintained below, the fluid vapor pressure thus inhibiting boiling and cavitation.

Another object is to create an additional zone surrounding the seal to insure that the fluid in the pump seal cavity is not boiling or cavitating, tapping the stable high pressure pump outlet fluid and routing it to an enclosed area around the seal.

Another object is to provide a pump having an intermediate pressure zone around the seal into which fluid can enter and exit, and the flow of the fluid is utilized as a heat transfer medium to cool the seal.

Another object is to provide a seal configuration in which the intermediate pressure zone is created within the seal which requires only a source of pressurized fluid.

Another object is to create an intermediate pressure zone by shrouding the seal.

Another object is to provide a pump and seal arrangement which is relatively simple, economical and easy to construct or retrofit, and which is most efficient in use for reducing seal damage and leakage due to fluid boiling and cavitation.

Other objects and advantages of the invention will become apparent as this description proceeds.

DESCRIPTION OF PREFERRED EMBODIMENTS

Figure 1:
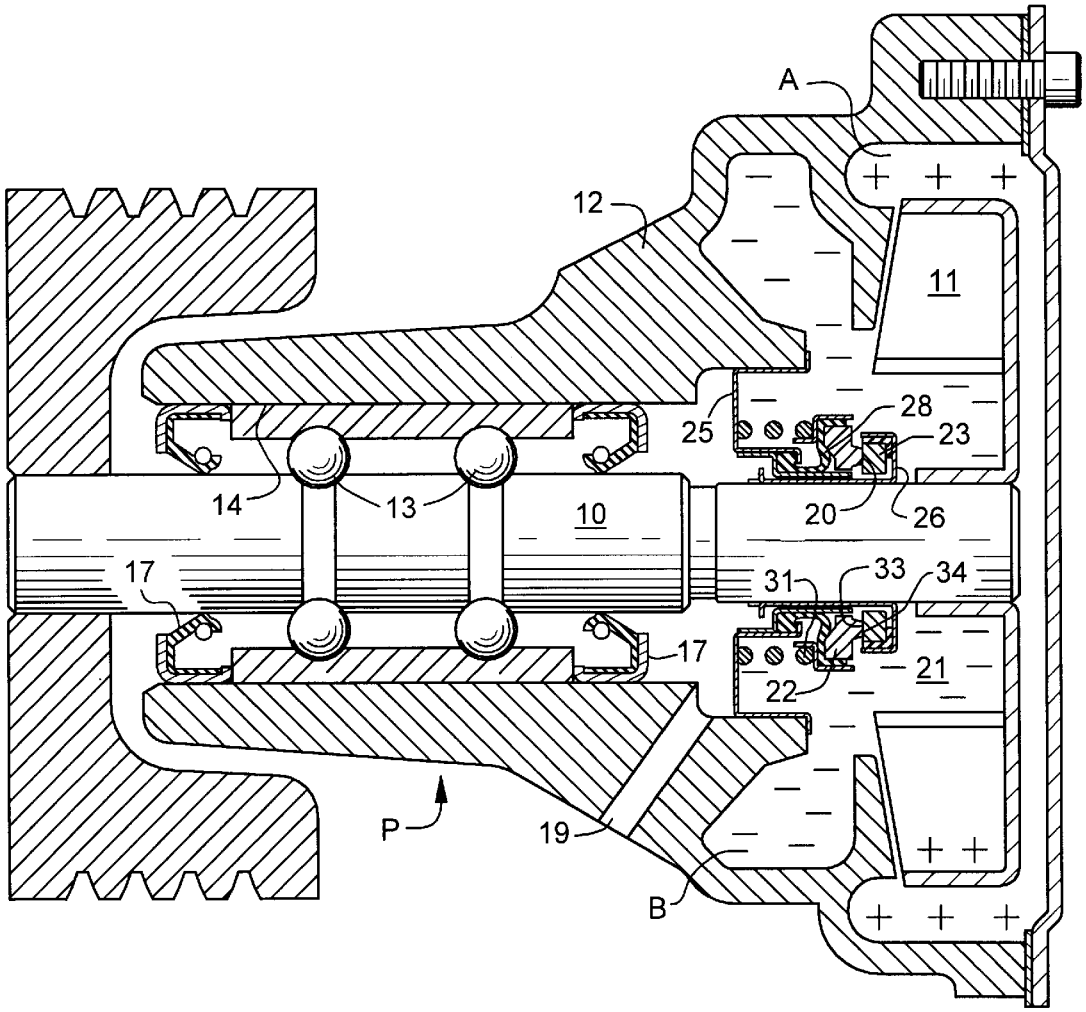
FIG. 1 PRIOR ART
FIG. 1 is a cross-sectional view of a typical conventional fluid pump consisting of a pump housing, impeller, face seal, pump shaft and bearing, the seal being located on the vane side or front of the impeller.

With reference to the accompanying drawings, and particularly to FIG. 1, in a typical conventional pump P a shaft 10 carries an impeller 11 secured on one end thereof within the pump housing 12. The shaft 10 may be mounted on bearings 13 which fit into the bearing bore 14 and bearing lubricant in the bore may be conventionally retained by radial lip seals 17. The pump housing 12 may have a drain passage 19 therein vented to atmosphere and acting as a weep hole in the event of seal leaks.

A seal 20 is used to close a fluid filled cavity 21 and such a seal comprises a stator body 22 interconnected with a rotor body 23 within the housing 12. The stator body 22 may have a flanged metallic ring 25 which secures the stator body 22 usually press fit into the housing 12.

A resilient annular membrane 28 may be utilized which has one end connected to the stator body 22 and its other end connected to the metallic ring 25. A spring 31 may be arranged adjacent to and bear against the stator body 22, keeping this body in face to face sealing arrangement with the rotor body 23.

As the shaft 10 and its impeller 11 turn, the rotor body 23 and its associated unitizing ring 26, which usually has been press fit on to the shaft 10, also turn, causing the sealing face 34 of the rotor body to rub on the sealing face 33 of the stator body 22, thus creating heat of friction.

Figure 2:
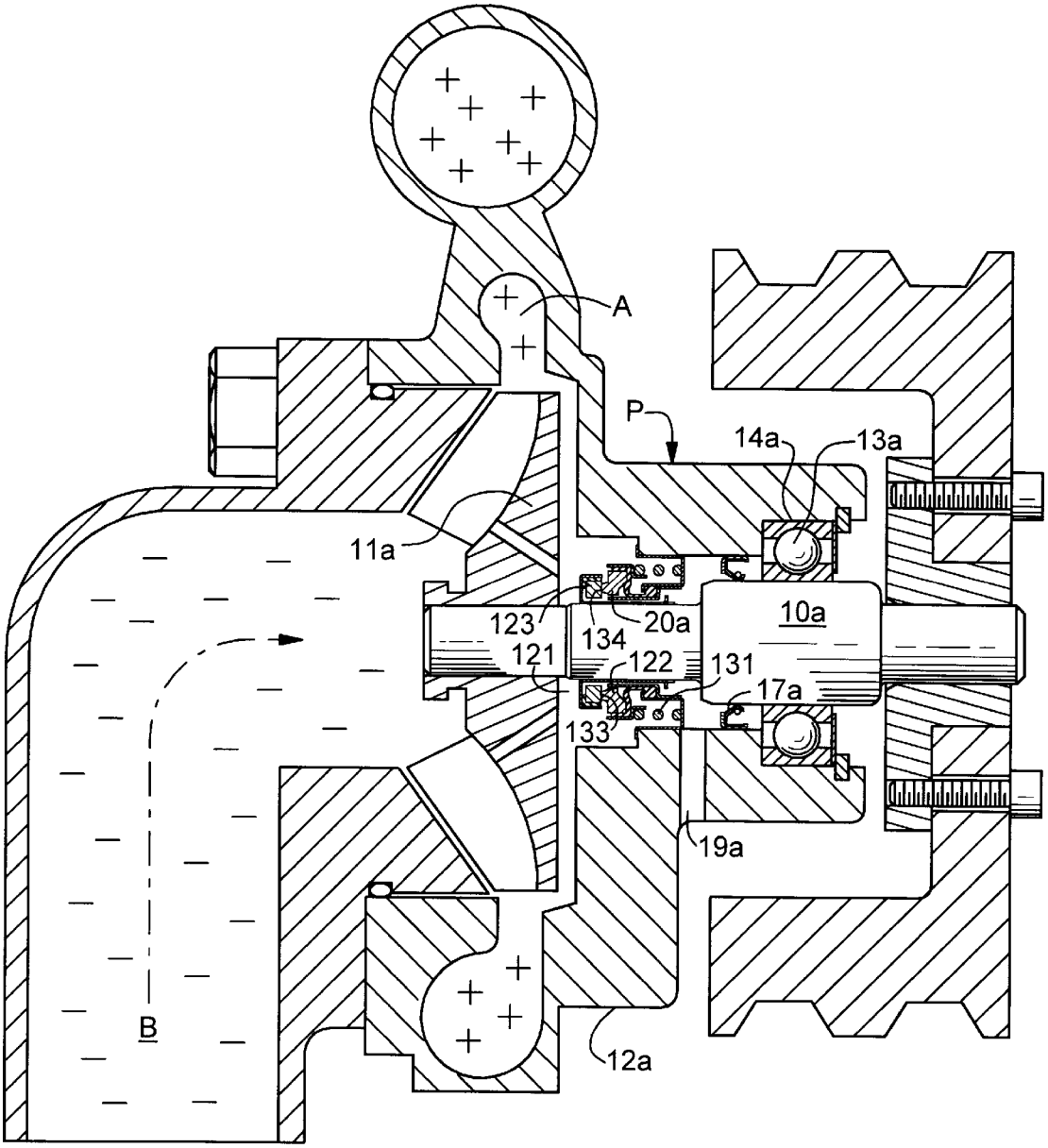
FIG. 2 PRIOR ART
FIG. 2 is a cross-sectional view of another typical pump housing, having parts similar to those shown in FIG. 1, except locating the seal on a the back side or rear of the impeller.

FIG. 2 shows another typical conventional pump P in which a pump housing 12*a*, having parts similar to those shown in FIG. 1, except locating the seal 20*a* secured on its shaft 10*a* on a side of the impeller 11*a* opposite to the side shown in FIG. 1. The bearing 13*a* fits into its bearing bore 14*a* closed by a bore seal 17*a*. This arrangement likewise has a weep hole 19*a*. Here the pump cavity 121 is closed by a stator body 122 secured in the pump housing 12*a* and a rotor body 123 secured on the shaft 10*a* . This seal 20*a* and its stator body 122 and rotor body 123 functions similarly to the structures of FIG. 1 and its spring 131 maintains the rotor and stator sealing faces 133 and 134, respectively, in sealing abutment.

Similar to those shown in FIG. 1, zones of pressure are created, which may be identified as Zone A at the outlet, and Zone B at the inlet of the pump cavity 121. Similarly, heat of friction at the rubbing faces of the seal can result in fluid boiling at the seal faces, depending upon the pressure and temperature of the fluid and whether the fluid has exceeded its vapor pressure point.

Figure 3:
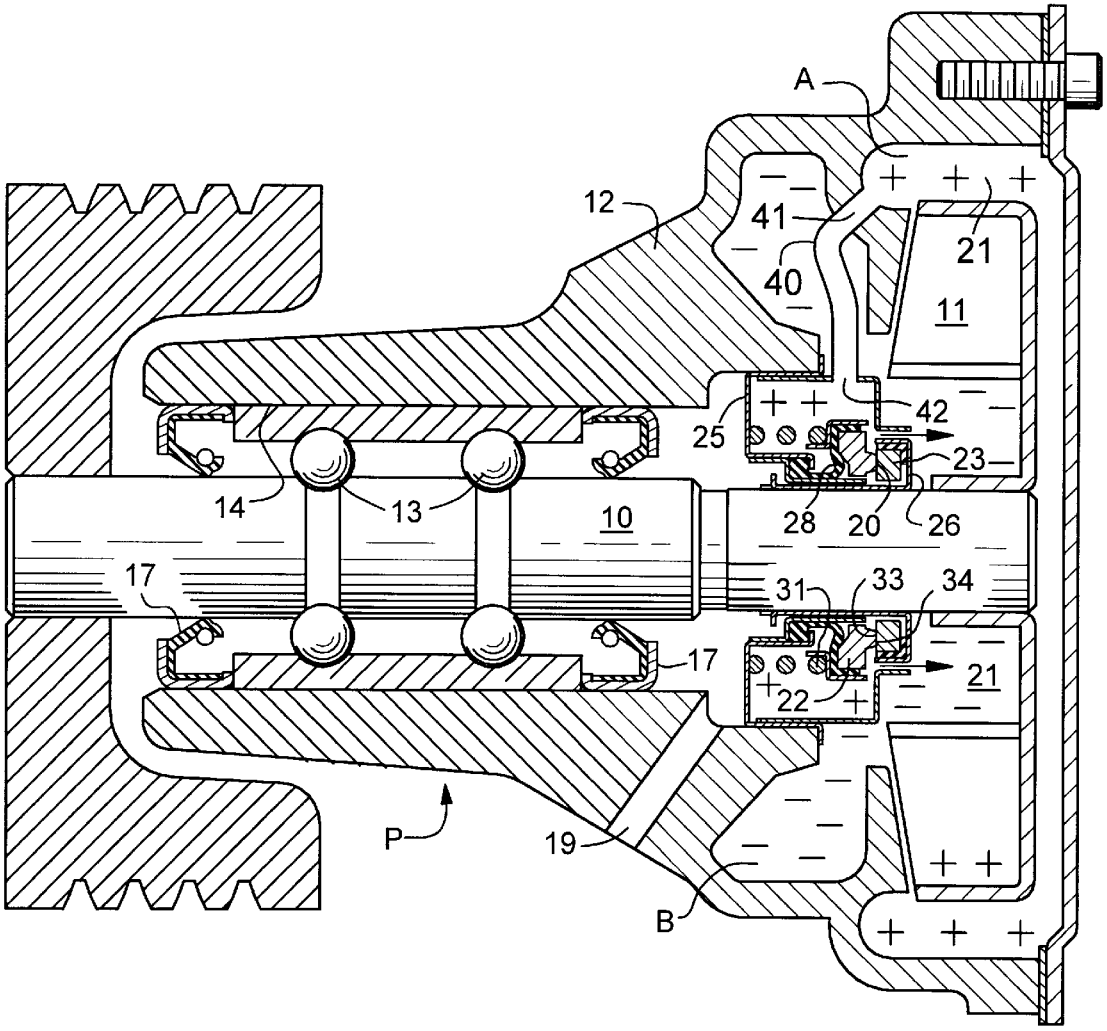
FIG. 3 is a cross-sectional view similar to FIG. 1, except showing a channel embodying the present invention tapped between the stable high pressure pump output zone and routing it to an enclosed area around the seal.

FIG. 3 is substantially similar to FIG. 1 in most respects, except that a third zone is created, identified as "zone C", which is distinguished from the higher pressure Zone A and the lower pressure Zone B. This Zone C is of intermediate pressure and is created by tapping the stable high pressure pump output fluid in Zone A and re-routing it to an enclosed area around the seal 20.

Such tapping is accomplished by providing a duct 40, which is preferably of lesser cross section that the outlet portion of the pump cavity 21, identified as Zone A, and has one end which opens at an outlet port 41 into that zone. The other end of this duct 40, defined as inlet port 42, opens into the area confined around the seal, creating Zone C, an area of intermediate controlled pressure. Fluid flows from Zone C into the lower pressure Zone B, which is accomplished because of the configuration of seal 20.

The ratio of the inlet area at port 42 to the exhaust area in the seal configuration will determine the fluid pressure in the zones and the rate of fluid flow past the seal 20. The purpose of Zone C is to surround the seal 20 with a pressure that will prevent the fluid in contact with the seal from boiling and cavitating when the pump is operating, a condition which may develop when the fluid pressure is above its vapor pressure point. The outlet flow from this zone when created in accordance with the present invention will provide heat transfer, thus cooling the seal.

Figure 4:
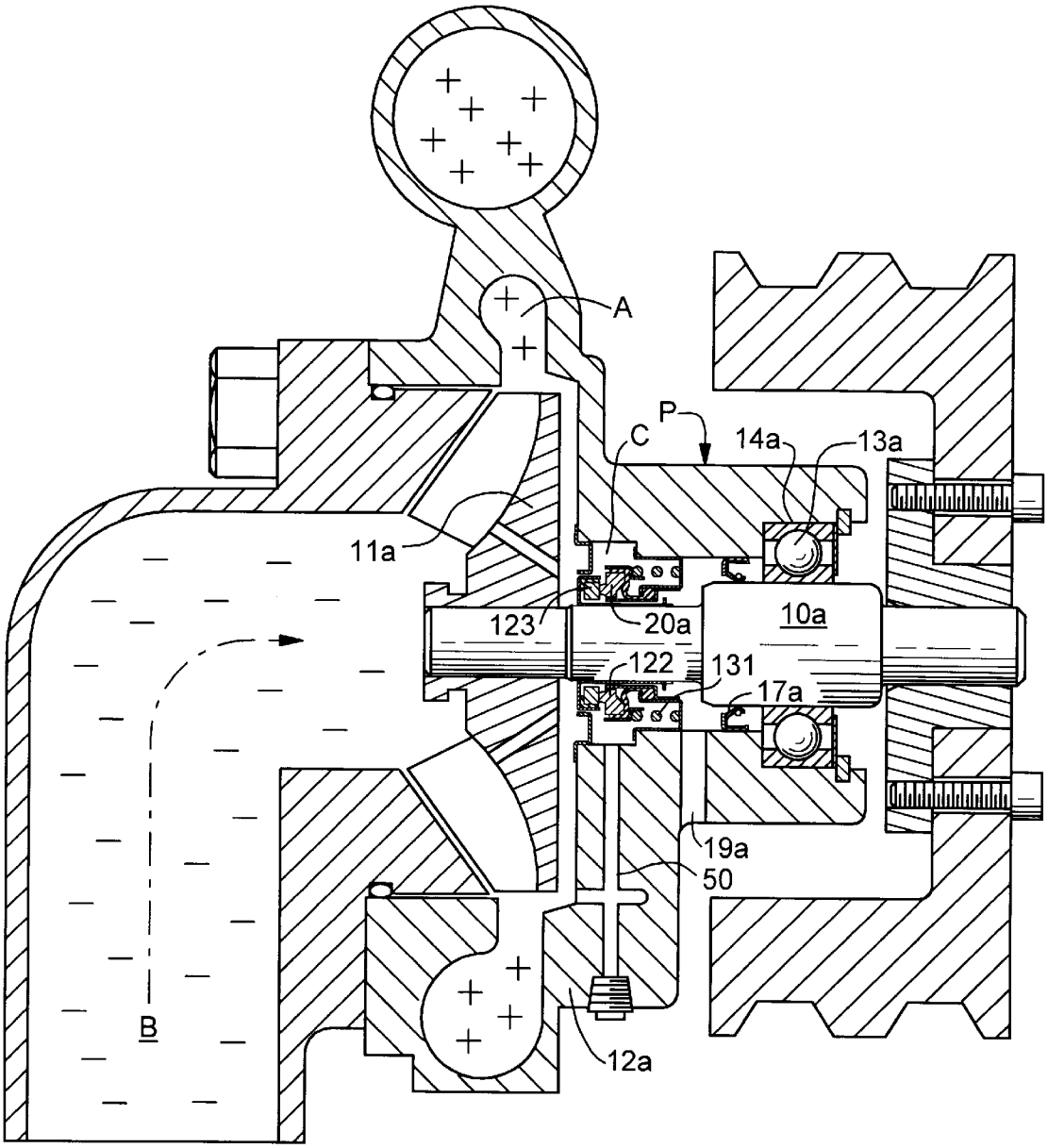
FIG. 4 is a cross-sectional view similar to FIG. 2, except showing a channel embodying the present invention connecting the high and lesser pressure zones of the pump cavity in a manner similar to FIG. 3, the channel structure being created in the pump castings.

As shown in FIG. 4, the interconnection 50 between the zones can be incorporated into the pump body architecture, thus utilizing the structure of the pump, as opposed to a special tube or pipe, as shown in FIG. 3.

Figure 5A:
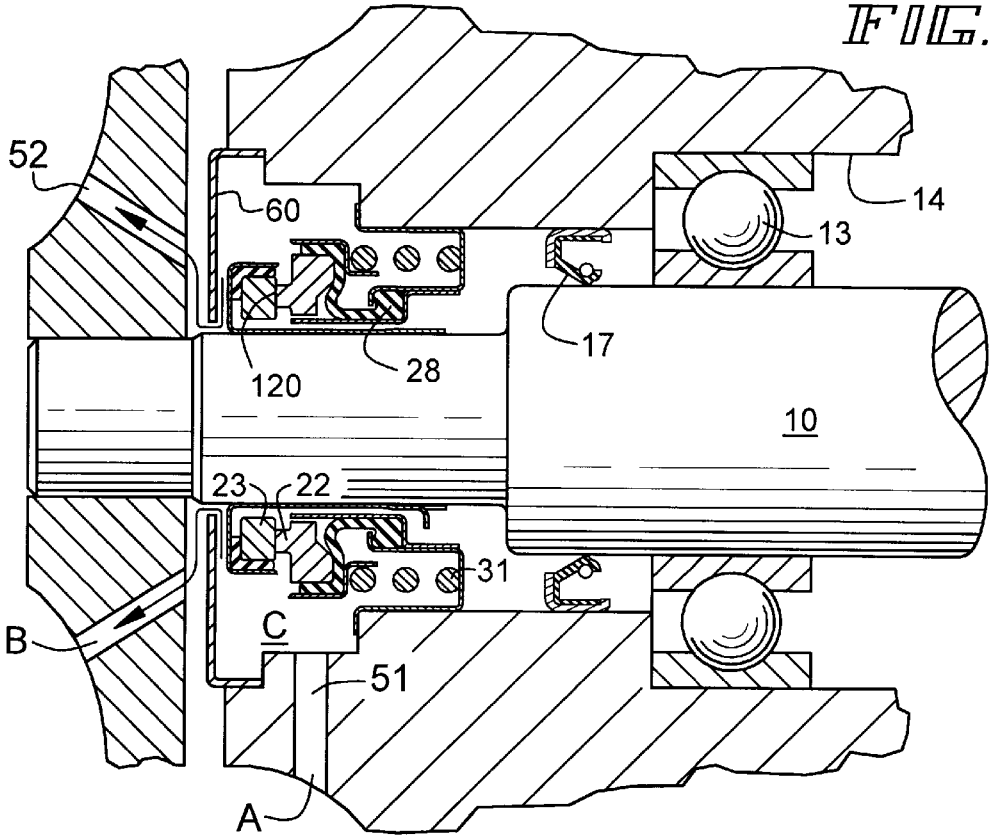
FIGS. 5A and 5B are cross-sectional views of part of the seal and pump cavity arrangement showing a shielding of a conventional face seal, thus creating an intermediate pressure zone and an ingress and egress path for the fluid.
Figure 5B:
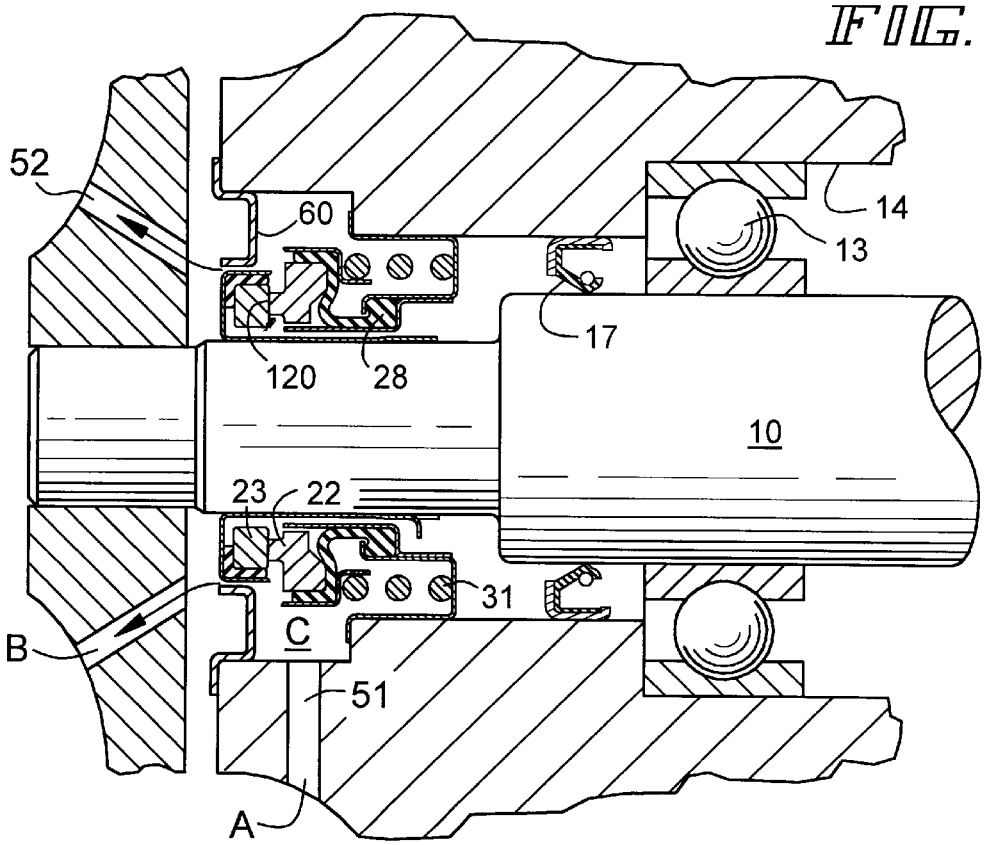
Figure 6:
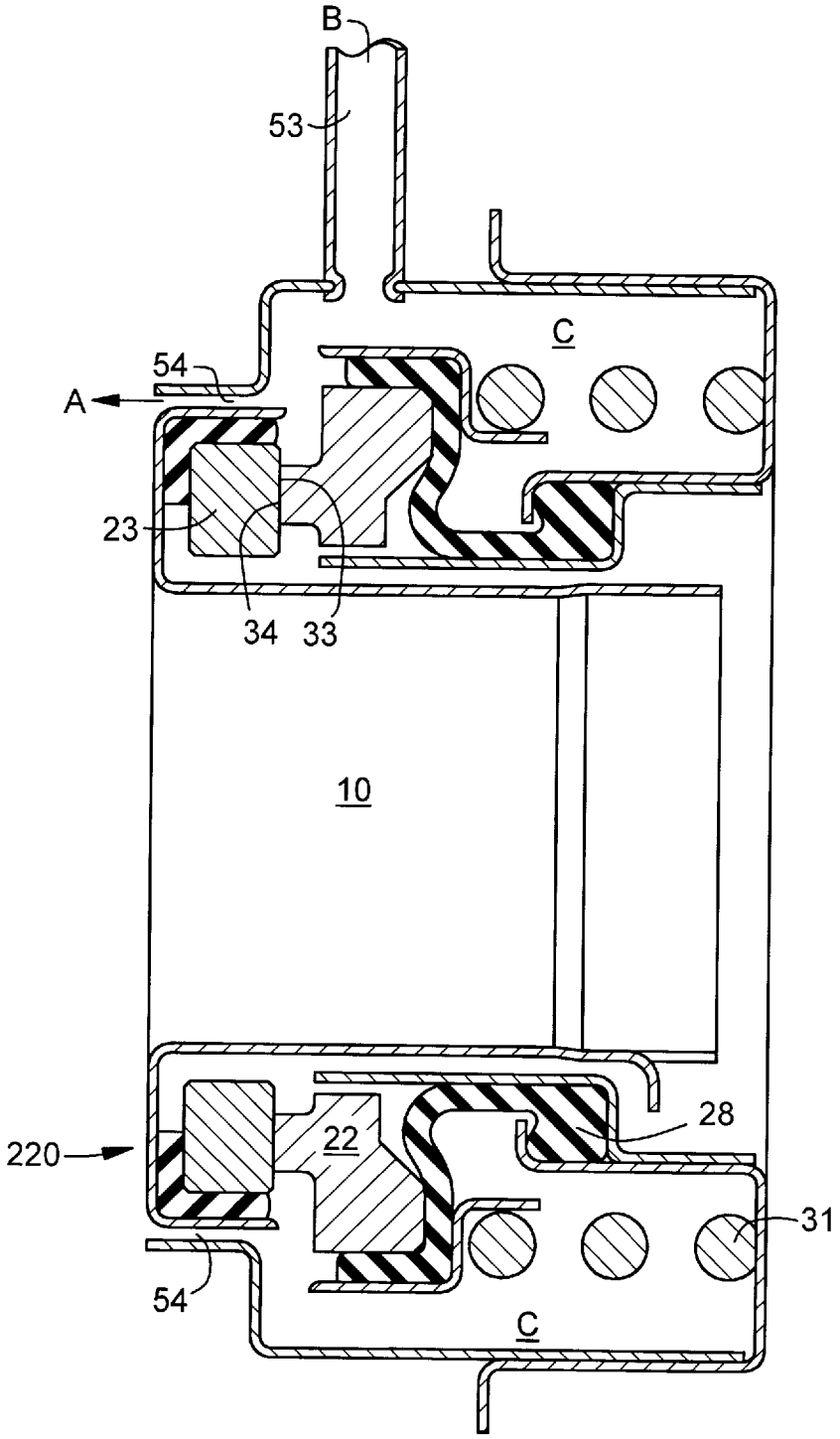
FIG. 6 is a cross-sectional view of a seal constructed according to the present invention having the interconnection between the high and lesser pressure zones built into the seal.

In FIGS. 5A and 5B, the special artificial Zone C of intermediate pressure can be constructed by a shielding 60 for the face seal 120, which can be created between the inlet 51 from Zone A and the outlet 52 to Zone B by the zone closure as seen in FIG. 5A or 5B. Alternatively, Zone C can be constructed as part of the seal 220, as shown in FIG. 6. Here the inlet 53 (B) and the outlet 54 (A) communicate with Zone C, which is constructed within the seal.

While preferred embodiments of the invention have been shown in considerable detail, it should be understood that many changes can be made in the structure shown without departing from the spirit or scope of the invention. Accordingly, it is not intended that this invention should be limited to the exact construction shown or described.

I claim:

1. In an operable fluid pump having a pump body defining a pump cavity and a pump shaft rotating on a bearing in a bearing chamber, said pump when operating having a seal arranged in said pump body on said shaft and having fluid adjacent said seal within said cavity, a chamber substantially enclosing said seal, a first zone for high pressure pump discharge fluid, and a second zone for low pressure pump inlet fluid, the improvement comprising a third zone of intermediate pressure fluid in said seal chamber between and in fluid communication with said first and second zones, said third zone having fluid flow therein sufficient to keep said fluid adjacent said seal below its vapor pressure point, said third zone being located in said seal.

2. In the pump recited in claim 1, wherein said third zone comprises an interconnection formed by a shrouding member arranged over said seal.

3. In the pump recited in claim 2, wherein said fluid flow in said chamber is utilized to cool the seal.

4. In the fluid pump recited in claim 1, wherein said pump has an impeller having an inlet side and an outlet side and said seal is arranged on said impeller inlet side.

5. In an operable fluid pump having a pump body defining a pump cavity and a pump shaft rotating on a bearing in a bearing chamber, said pump when operating having a seal arranged in said pump body on said shaft and having fluid adjacent said seal within said cavity, a chamber substantially enclosing said seal, a first zone for high pressure pump discharge fluid, and a second zone for low pressure pump inlet fluid, the improvement comprising a third zone of intermediate pressure fluid in said seal chamber, said third zone having fluid flow therein sufficient to keep said fluid adjacent said seal below the vapor pressure point of said fluid, said third zone being formed by providing a passage tapped into said pump body.

6. In a method for providing in a seal chamber of a pump body, said seal chamber containing rubbing faces of a seal, a zone to maintain pressure of pumped fluid in said seal chamber below the vapor pressure of said fluid, said seal chamber having arranged therein the rubbing faces of the seal in face to face juxtaposition within said seal chamber substantially enclosing said seal faces, said method comprising the steps of ascertaining a location of a first fluid zone for high pressure pump discharge fluid within said pump body, ascertaining a location of a second fluid zone for low pressure pump inlet fluid within said pump body, and connecting said first and second zones to provide a fluid zone of intermediate fluid pressure in said seal chamber, said intermediate pressure zone being formed by tapping a passage into said pump body.

7. In a method for providing in a seal chamber containing rubbing faces of a seal arranged in a pump body, a zone to maintain pressure of pumped fluid in said seal chamber below the vapor pressure of said fluid, said seal chamber having arranged therein the rubbing faces of the seal in face to face juxtaposition within said seal chamber substantially enclosing said seal faces, said method comprising the steps of ascertaining a location of a first fluid zone for high pressure pump discharge fluid within said pump body, ascertaining a location of a second fluid zone for low pressure pump inlet fluid within said pump body, and connecting said first and second zones to provide a fluid zone of intermediate fluid pressure in said seal chamber, said intermediate pressure zone being formed by providing shielding in said seal chamber connecting said first and second zones.

8. In the method recited in claim 7, with the additional step of shrouding said seal chamber to form said intermediate pressure zone by placing said first and second zones in fluid communication one with the other within said seal cavity.

* * * * *